United States Patent [19]

Trotta

[11] Patent Number: 4,486,952

[45] Date of Patent: Dec. 11, 1984

[54] SHAVING IMPLEMENT

[75] Inventor: Robert A. Trotta, Pembroke, Mass.

[73] Assignee: The Gillette Company, Boston, Mass.

[21] Appl. No.: 540,657

[22] Filed: Oct. 11, 1983

Related U.S. Application Data

[63] Continuation of Ser. No. 298,727, Sep. 3, 1981, abandoned, which is a continuation-in-part of Ser. No. 194,551, Oct. 6, 1980, Pat. No. 4,354,312.

[51] Int. Cl.[3] ..... B26B 21/22

[52] U.S. Cl. ..... 30/47; 30/50

[58] Field of Search ..... 30/47, 30, 51, 32, 50

[56] References Cited

U.S. PATENT DOCUMENTS

| | | | |
|---|---|---|---|
| 1,195,259 | 8/1916 | O'Reilly | 30/47 |
| 1,735,751 | 11/1929 | Green | 30/47 |
| 1,864,995 | 6/1932 | Frost | 30/32 |
| 2,729,887 | 1/1956 | Appeldorn | 30/47 X |
| 2,780,862 | 2/1957 | Grathwohl | 30/32 |
| 3,703,764 | 11/1972 | Perry | 30/32 |
| 3,724,070 | 4/1973 | Dorion | 30/47 |
| 3,852,883 | 12/1974 | Ferraro | 30/50 X |
| 4,026,016 | 5/1977 | Nissen | 30/50 X |
| 4,084,316 | 4/1978 | Francis | 30/50 X |
| 4,354,312 | 10/1982 | Trotta | 30/47 |

*Primary Examiner*—Jimmy C. Peters

*Attorney, Agent, or Firm*—Scott R. Foster

[57] ABSTRACT

A shaving implement including a platform portion, a back portion, a cap portion overlying the platform portion, end walls interconnecting the platform and cap portions, the platform, back, cap and end wall portions being an integrally molded plastic unit, and a blade member permanently disposed between the cap and platform portions, the cap portion exercizing a clamping pressure on the blade member.

1 Claim, 10 Drawing Figures

SHAVING IMPLEMENT

CROSS-REFERENCE TO RELATED APPLICATION

This is a continuation of application Ser. No. 298,727, filed Sept. 3, 1981, now abandoned, which in turn is a continuation-in-part of application Ser. No. 194,551, filed Oct. 6, 1980, now U.S. Pat. No. 4,354,312, in the name of Robert A. Trotta.

BACKGROUND OF THE INVENTION

1. Field of the Invention

The invention relates to wet shaving systems and is directed more particularly to a low-cost highly maneuverable wet shaving device.

2. Description of the Prior Art

It is generally known in the art to provide a housing having platform and cap portions adapted to receive a blade means therebetween. In U.S. Pat. No. 1,195,259, issued Aug. 22, 1916 to W. E. O'Reilly, there is shown a platform and cap portion formed from a single piece of metal, the cap overlying the platform.

It is also generally known to embed a blade in a plastic shaving head, the head being permanently attached to a handle, or alternatively, removable from a handle for replacement by another shaving head. U.S. Pat. No. 1,864,995, issued June 28, 1932 to T. H. Frost shows such an arrangement.

More recent examples of plastic shaving heads having blades fixed therein include U.S. Pat. No. 3,703,764, issued Nov. 28, 1972 to Roger L. Perry, U.S. Pat. No. 3,724,070 issued Apr. 3, 1973 to Francis W. Dorion, and U.S. Pat. No. 4,026,016 issued May 31, 1977 to Warren I. Nissen. While such recent examples have been eminently successful, there is, as always, a need for such products which are less expensive to manufacture and offer improved functional characteristics.

A combination of the simplicity of the O'Reilly device and the more recent blade-in-plastic shaving implements would afford significant cost savings, and at the same time permit manufacture of a more maneuverable, more easily handled shaving implement.

Recognizing that it is only the cutting edge of a razor blade that does a razor's work, there have been attempts to use narrower blades. In most cartridge-type shaving units blades are retained in plastic cartridges by the passing of plastic posts, or pins, through holes in the blades and heading over the posts. While such method has successfully accomplished its goal, the use of "rivets" of this sort requires a blade of a width of about 1/10 inch, limiting to a great extent the degree of narrowness possible. Efforts have been made, as described in U.S. Pat. No. 4,084,316, issued Apr. 18, 1978, to John F. Francis, to utilize very narrow blades by way of welding the blades to a support, such as a rigid wire. Welding presents problems by virtue of the heat required and the effect of such heat on the blade metal.

Accordingly, there exists a need for a shaving implement construction which will permit use of blades narrower than 1/10 inch but not such as to subject the blades to harmful temperatures, or other deleterious conditions, during fabrication.

SUMMARY OF THE INVENTION

It is therefore an object of the present invention to provide a shaving implement including blade means disposed between cap and platform portions which operate to retain the blade means without need of rivet portions, or the like.

A further object of the invention is to provide a shaving implement utilizing narrow blade means disposed between the cap and platform portions and retained therebetween.

With the above and other objects in view, as will hereinafter appear, a feature of the present invention is the provision of a shaving implement comprising a platform member, a back portion, upstanding from a lengthwise margin of the platform portion a cap portion extending from the back portion and overlying the platform portion, end walls interconnecting the platform and cap portions at either end thereof, the platform, back, cap and end wall portions being an integrally molded plastic unit, the cap portion being adapted, in an unstressed state, to incline toward the platform portion to a first position, and blade means permanently disposed between the cap and platform portions and adjacent the back portion, the blade means stressing the cap portion and retaining the cap portion in a second position further removed from the platform portion than the first position, the cap portion thereby exercising a clamping pressure on the blade means.

The above and other features of the invention, including various novel details of construction and combinations of parts, will now be more particularly described with reference to the accompanying drawings and pointed out in the claims. It will be understood that the particular device embodying the invention is shown by way of illustration only and not as limitation of the invention. The principles and features of this invention may be employed in various and numerous additional embodiments without departing from the scope of the invention.

BRIEF DESCRIPTION OF THE DRAWINGS

Reference is made to the accompanying drawings in which is shown illustrative embodiment of the invention from which its novel features and advantages will be apparent.

In the drawings.

DESCRIPTION OF THE PREFERRED EMBODIMENTS

Figure 1:
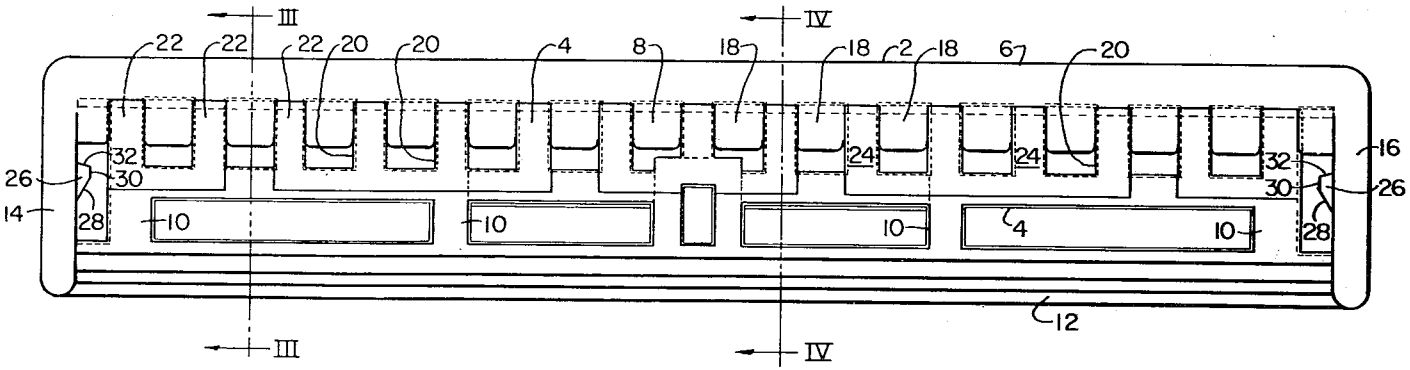
FIG. 1 is a top plan view of a housing suitable for use in an illustrative embodiment of the invention.

Referring to the drawings, and particularly FIGS. 1-4, it will be seen that an illustrative housing 2 includes a platform portion 4. A back portion 6 upstands from a lengthwise margin of the platform portion 4, and a cap portion 8 extends forwardly from the back portion 6 to overlie the platform portion. The housing further includes leg portions extending forwardly from the platform portion and joining a guard portion 12 which is disposed parallel to the back portion 6. The housing is further provided with end walls 14, 16 interconnecting the back and guard portions at the ends of the housing.

Figure 8:
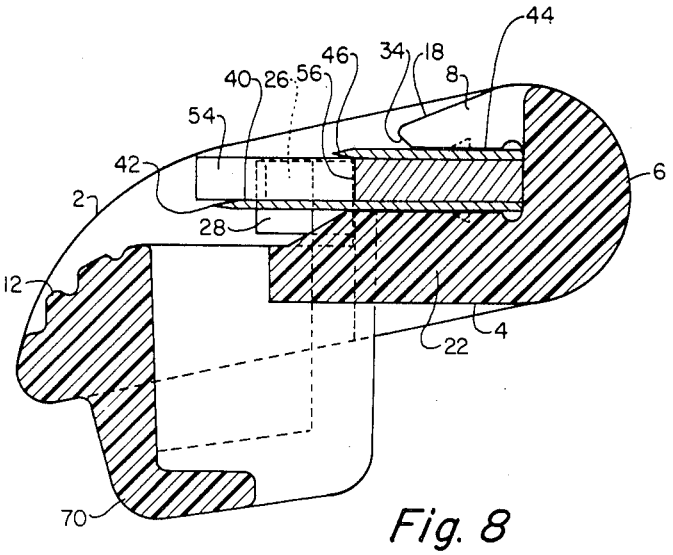
FIG. 8 is a sectional view taken along line VIII—VIII of FIG. 6.

The cap portion 8 in an unstressed state (FIGS. 3 and 4) is adapted to incline toward the platform portion 4 to a first position. The cap portion is sufficiently flexible to receive a blade means therebeneath, the blade means stressing the cap portion to a second position (FIG. 8) further removed from the platform portion than the first position. The cap portion thereby exercises a clamping pressure on the blade means.

The cap portion 8 may comprise a series of spaced, aligned, forwardly extending fingers 18. The platform portion may be provided with a series of spaced, aligned recesses 20, the recesses being separated by platform rib portions 22. As may be seen in FIG. 1, each of the fingers 18 is disposed over one of the recesses 20 and each of the rib portions 22 is in alignment with a space between two of the fingers 18.

Preferably, the entire housing, and at least the platform back, cap and portions, is of molded plastic and is molded as an integral unit. The fingers 18 are in effect leaf springs adapted to flex to receive a blade means between the fingers and the platform and further serve to urge the blade means against an upper surface 24 of the platform portion.

Figure 2:
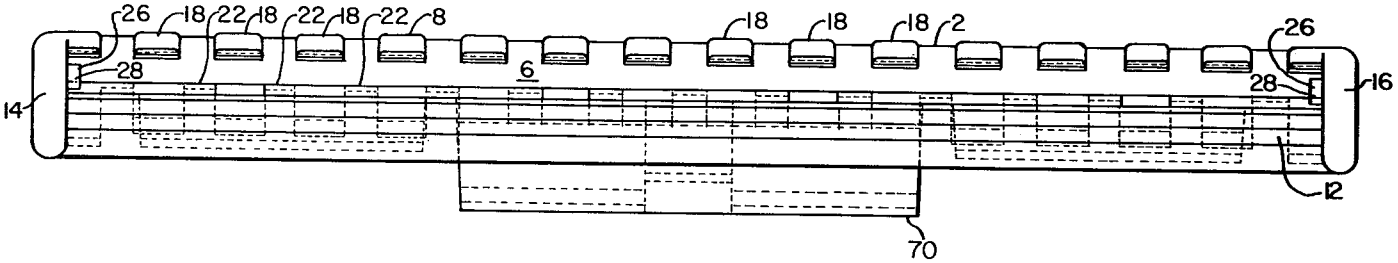
FIG. 2 is a front elevational view thereof.
Figure 4:
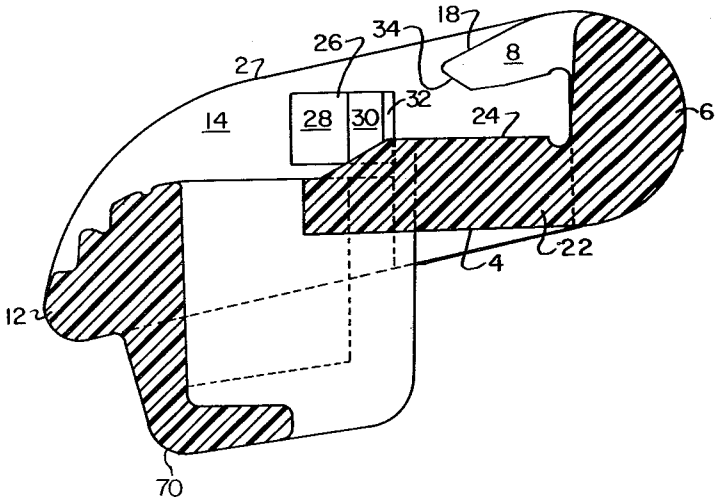
FIG. 4 is a sectional view taken along line IV—IV of FIG. 1.
Figure 3:
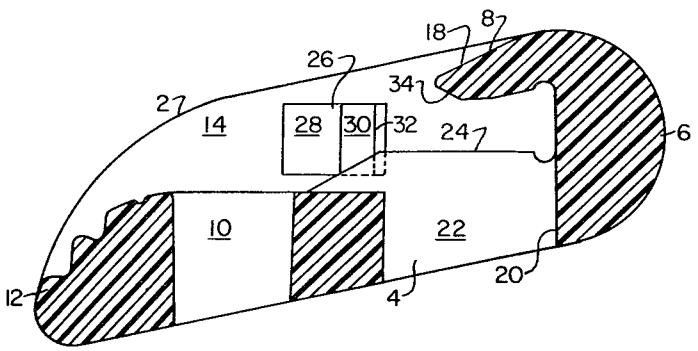
FIG. 3 is a sectional view taken along line III—III of FIG. 1.

In a preferred embodiment, the end walls 14, 16 are provided with inwardly extending projections 26 which are opposed to each other, as seen in FIGS. 1 and 2. The projections provide an additional blade means retention facility. Each projection includes a forward surface 28 extending from the end wall on which the projection is mounted obliquely to a side surface 30. A rear surface 32 interconnects the rearward edge of the side surface and the end wall surface. The function and operation of the projections 26 will be further described hereinbelow.

Each of the fingers 18 include a guide surface 34, serving to guide a blade means into the gap, or pocket, formed by the platform and back portion and the fingers. As noted above, the fingers 18 are formed such that while extending forwardly, the fingers also extend slightly downwardly, as viewed in FIGS. 3 and 4, or toward the platform surface 24.

Figure 5:
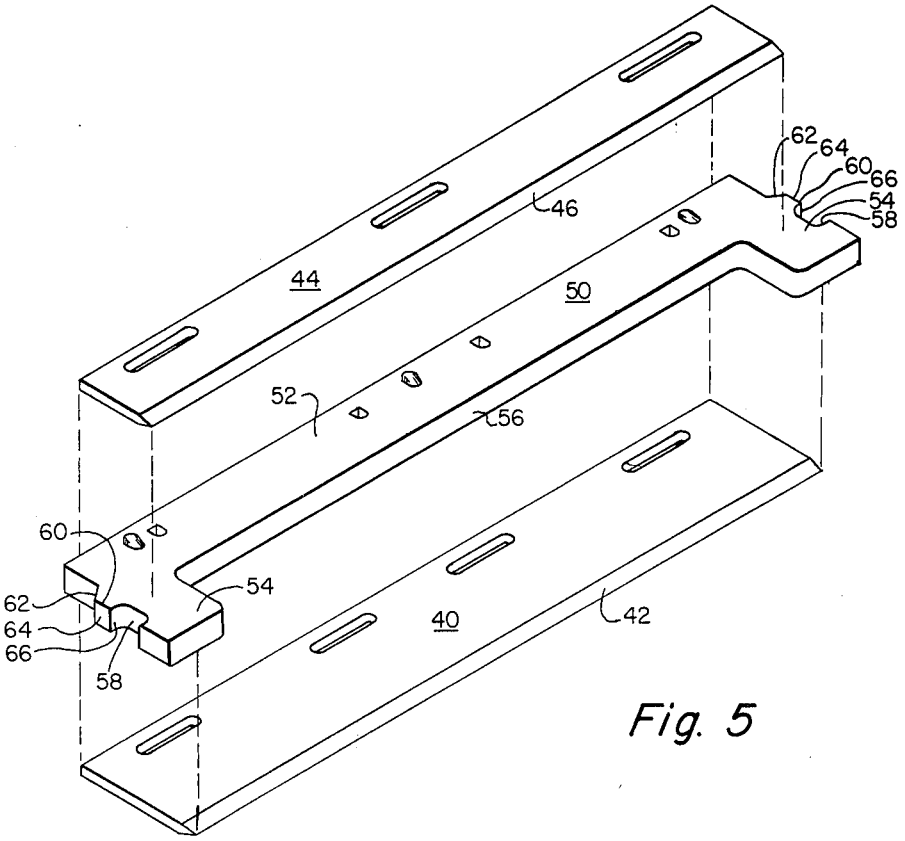
FIG. 5 is an exploded perspective view of an illustrative blade means.

Referring to FIG. 5, it will be seen that a blade means suitable for use with the above-described housing includes a first blade 40 having a cutting edge 42 and a narrower second blade 44 having a cutting edge 46, the blades 40, 44 being fixed to either side, respectively, of a spacer member 50. The spacer member 50 includes an elongated central portion 52 and end portions 54 extending forwardly of a frontal edge 56 of the central portion 52 and having outwardly-facing notches 58 therein adapted to receive the projections 26. The notches 58 are defined in part by extensions 60, each having a cam surface 62, an outer surface 64, and a notch surface 66.

Figure 6:
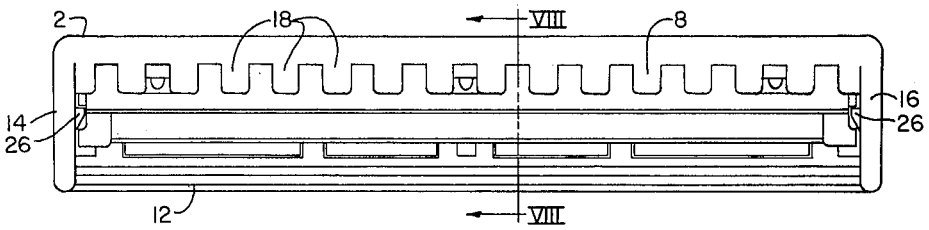
FIG. 6 is a top plan view of one form of shaving implement illustrative of the preferred embodiment of the invention.
Figure 7:
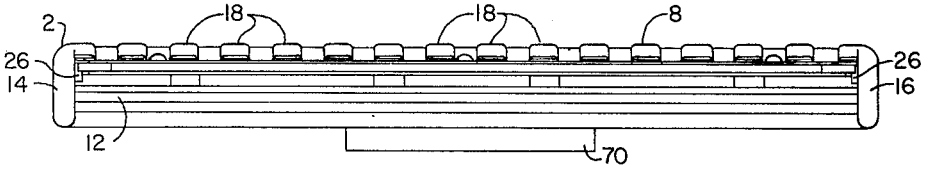
FIG. 7 is a front elevational view of the shaving implement.

In assembly, the blade means including the first blade 40, spacer 50, and second blade 44, is inserted between the fingers 18 and the upper surfaces 24 of the rib portions 22, the finger guide surfaces 34 guiding and urging the blade means into place. The cam surface 62 engages the projection forward surface 28. Continued pressure on the blade means causes the extensions 60 to override the projections 26, with the notches 58 coming to rest about the projections 26, as seen in FIG. 6.

The blade and spacer portions of the blade means are retained in position relative to each other solely by the pressure thereon exercised by the cap portion 8 and are otherwise not attached to each other. There being no rivet connecting means, it will be apparent that the width of the blade is not a critical factor and a very narrow blade, less than 1/10 inch from the cutting edge to rearward edge, may be used.

Figure 9:
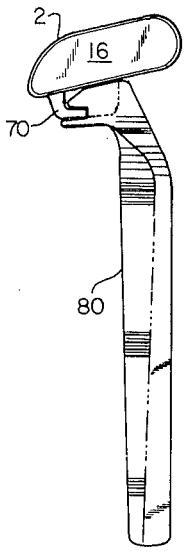
FIG. 9 is a side elevational view of one form of razor illustrative of another embodiment of the invention.

Referring to FIG. 9, it will be seen that the housing may be provided with means for attachment to a razor handle. While such means may comprise the well known groove means disclosed in the aforementioned U.S. Pat. No. 3,724,070, or journal bearing means as disclosed in the aforementioned U.S. Pat. No. 4,026,016, in the embodiment shown in FIGS. 1–4, the housing is provided with connecting means 70 adapted to be engaged by a razor handle 80. The handle 80 may be of the type permanently connected to the housing 2, or may be of the type selectively connected and disconnected to and from the handle.

Figure 10:
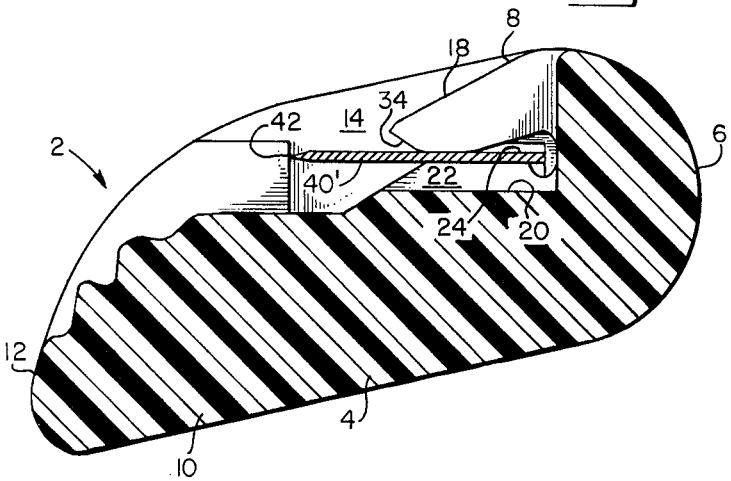
FIG. 10, is a sectional view similar to FIG. 8, but showing still another embodiment of the invention.

It is to be understood that the present invention is by no means limited to the particular construction herein disclosed and/or shown in the drawings, but also comprises any modifications or equivalents within the scope of the disclosure. For example, the blade means need not comprise a plurality of components, but may instead comprise a single blade 40 disposed between the platform and cap portions 4, 8 of the unit, as illustrated in FIG. 10 of the drawings.

Having thus described my invention, what I claim as new and desire to secure by Letters Patent of the United States is:

1. A shaving implement comprising a platform portion provided with a series of spaced rib portions defining recesses therebetween, a back portion upstanding from a lengthwise margin of said platform portion, a cap portion comprising a series of spaced forwardly extending fingers extending from said back portion and overlying said platform portion, each of said fingers being disposed over one of said recesses, end walls interconnecting said platform and cap portions at either end thereof, said platform, back, cap and wall portions being an integrally molded plastic unit, said cap portion fingers being adapted, in an unstressed state, to incline toward said platform portion to a first position, and blade means physically distinct from said plastic unit and permanently disposed between said cap and platform portions and adjacent said back portion, said blade means comprising a first blade member, a spacer member, and a second blade member, said spacer member being disposed between said first and second blade members, said blade and spacer members being in abutting engagement, said blade means stressing said cap portion fingers and retaining said cap portion fingers in a second position further removed from said platform portion than said first position, said cap portion thereby exercising a clamping compressive pressure on said blade means, said blade means being held together in said compressive abutting relationship by said clamping pressure but otherwise being unconnected.

* * * * *